United States Patent [19]

Tullis et al.

[11] 4,408,195

[45] Oct. 4, 1983

[54] BOUNDARY PLANE WARNING SYSTEM

[75] Inventors: Barclay J. Tullis, Palo Alto; Randy J. Tan, Hayward, both of Calif.; John F. McKeon, Carmel, Ind.

[73] Assignee: FMC Corporation, Chicago, Ill.

[21] Appl. No.: 293,814

[22] Filed: Aug. 17, 1981

[51] Int. Cl.[3] ..... G08B 21/00

[52] U.S. Cl. ..... 340/685; 180/168; 212/153; 340/507;540;557

[58] Field of Search ..... 340/685, 684, 679, 32, 340/38 P, 557, 555, 540, 507; 212/153; 180/167, 168

[56] References Cited

U.S. PATENT DOCUMENTS

| | | | |
|---|---|---|---|
| 3,128,840 | 4/1964 | Barrett, Jr. | 180/167 |
| 3,370,285 | 2/1968 | Cruse et al. | 340/556 |
| 3,476,946 | 11/1969 | Kepner . | |
| 3,476,947 | 11/1969 | Burney . | |
| 3,476,948 | 11/1969 | Mengers . | |
| 3,553,670 | 1/1971 | Toles | 340/679 |
| 3,623,057 | 11/1971 | Hedin et al. . | |
| 3,641,549 | 2/1972 | Misek et al. . | |
| 3,688,298 | 8/1972 | Miller et al. . | |
| 3,739,372 | 6/1973 | Schlisser et al. . | |
| 3,786,468 | 1/1974 | Moffitt | 340/685 |
| 3,825,745 | 7/1974 | Thomson . | |
| 3,825,916 | 7/1974 | Steele et al. . | |
| 3,898,639 | 8/1975 | Muncheryan . | |
| 4,064,997 | 12/1977 | Holland et al. | 340/685 |
| 4,099,669 | 7/1978 | Cortopassi | 180/167 |
| 4,143,264 | 3/1979 | Gilbert et al. | 340/32 |
| 4,227,595 | 10/1980 | Hamada | 180/167 |
| 4,328,545 | 4/1982 | Halsall et al. | 180/167 |

*Primary Examiner*—Glen R. Swann, III

*Attorney, Agent, or Firm*—Lloyd B. Guernsey; Henry M. Stanley; Richard B. Megley

[57] ABSTRACT

A laser transmitter emits a beam which scans about a scanning axis to effect a curtain of light which defines a boundary of a working space. Photosensors mounted on the outboard portion of a crane or other construction equipment generate warning signals to the construction equipment operator and other nearby personnel whenever these photosensors move into the light curtain. Additional curtain sensing equipment positioned to intercept the rotating laser beam with each cycle of rotation develops an alarm signal which activates an alarm horn and/or alarm light whenever the laser transmitter fails to provide the light curtain. The additional curtain sensing equipment is mounted an appropriate distance from the laser transmitter so that such additional sensing equipment will not interfere with the reception of the light curtain by the photosensors on the crane, and the laser transmitter and the additional curtain sensing equipment are mounted several feet above the ground to prevent foot traffic and vehicle traffic from producing false indications of a laser transmitter failure by intercepting the light curtain.

19 Claims, 17 Drawing Figures

FIG_3A
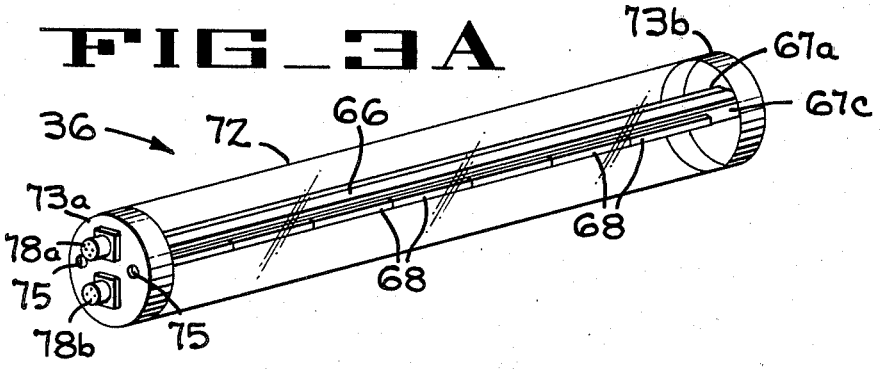
FIG_4
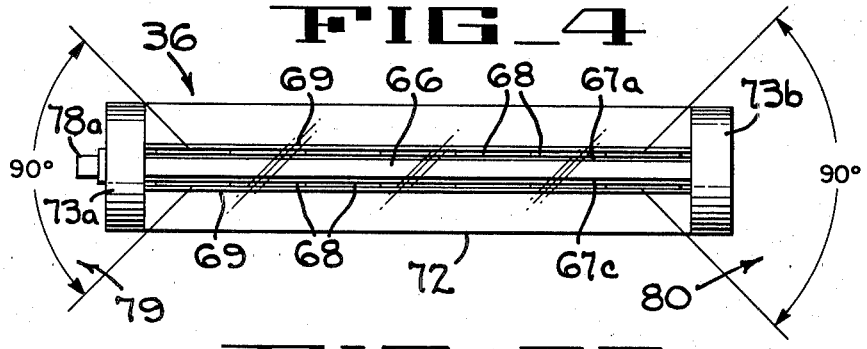
FIG_3B
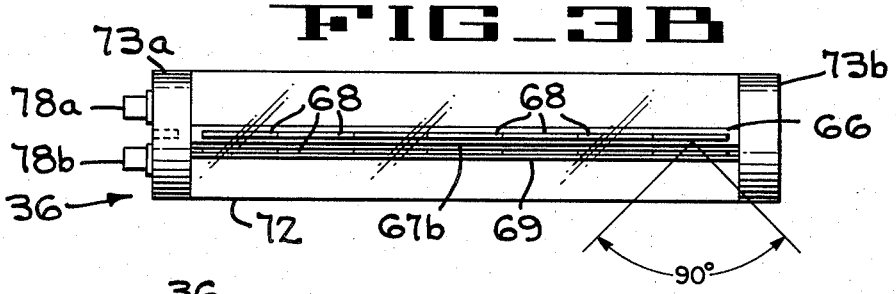
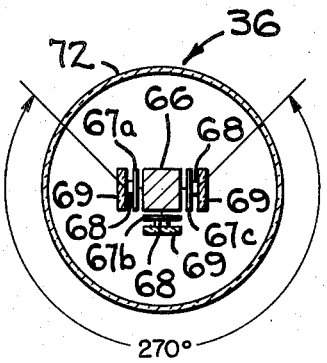
FIG_3C
FIG_5
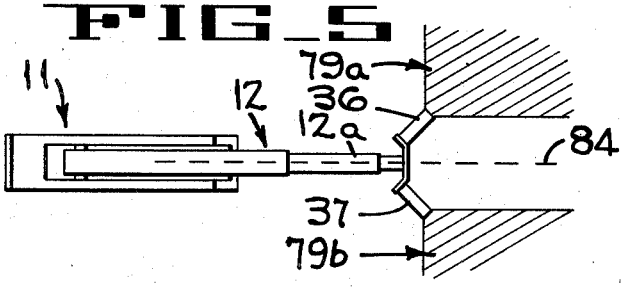
FIG_6
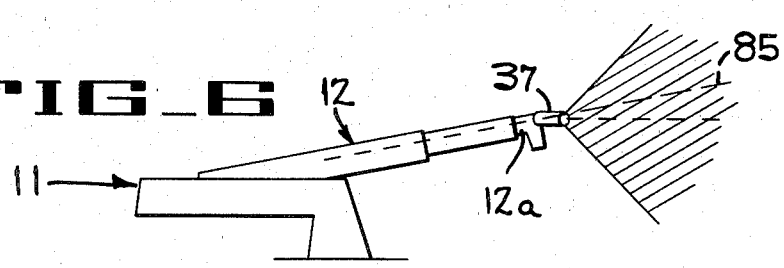

FIG_7
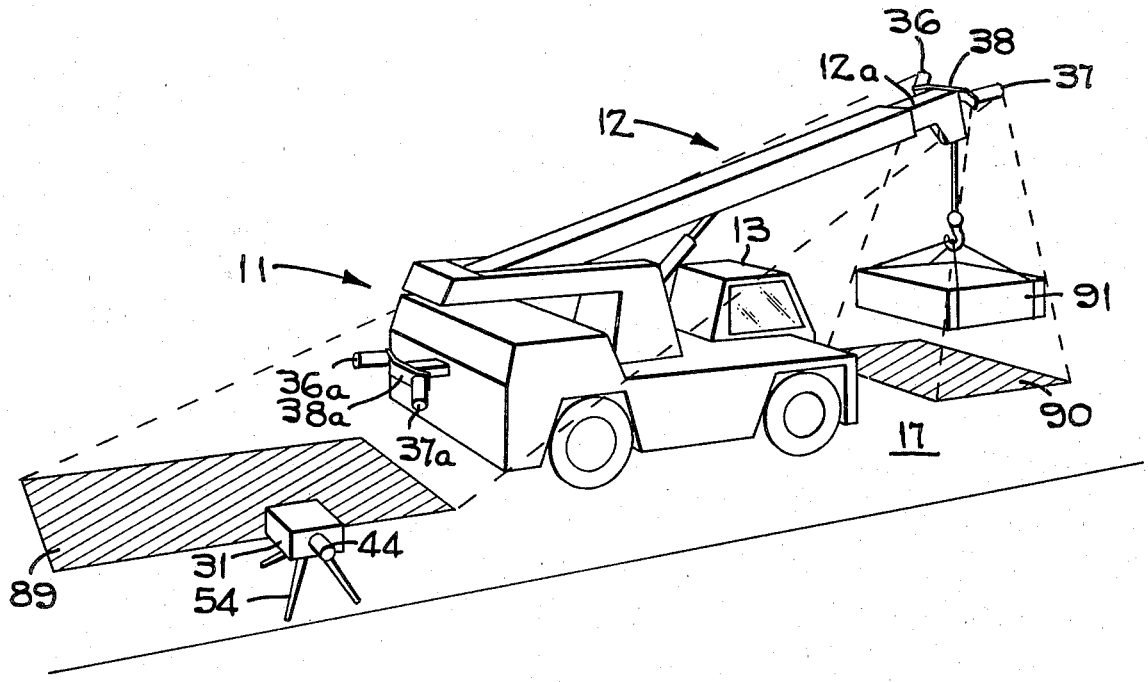
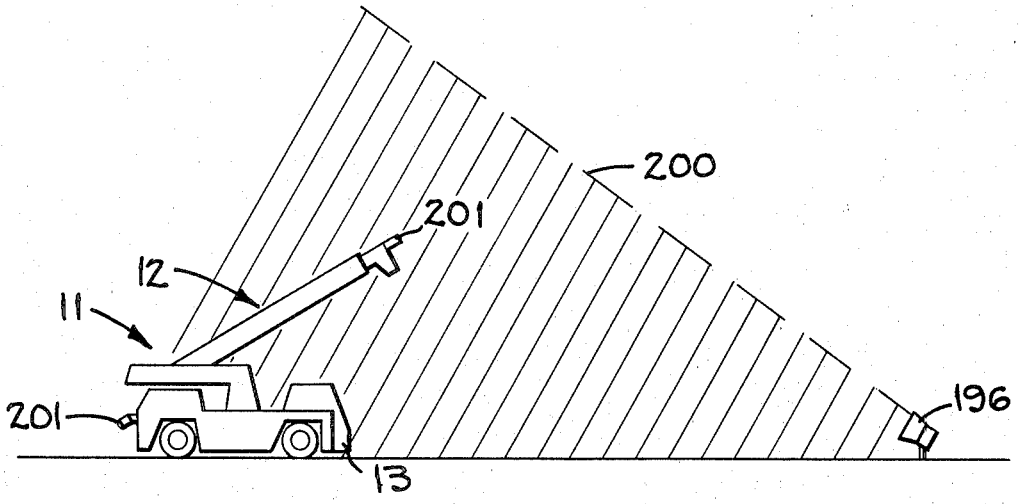
FIG_8

151
152
157
Vcc
D
TH
TR
R
CV
+V.
153
VZ
C
I
VR
N
V+
Vc
V-
158
159
163
DP
V+
B
S7
168
166
164
167
165
S6
145
147
146
140
141
135
LED5
LED4
139
Q
R
CK
+12V.
S4
C2
R9
133
TR
127
60
62
61

158a
151a
152a
184
187
182
189
178
171
176
139a
177
191
R13
C6
S9
133a
190
188
134a
C3
172
173
127a
170
183
197
S10
194
195
B
DP
V+
VZ
C
I
VR
V-N
Vc
THD
TR
R
CK
S
D
Q
CV
+V 11
12
13
31
31a
36
37
55
202
203
207
208
209
213
214
215

BOUNDARY PLANE WARNING SYSTEM

BACKGROUND OF THE INVENTION

1. Field of the Invention

This invention relates to safety apparatus and, more particularly, to a system for warning that a portion of a crane or other construction equipment has intercepted a boundary of a working space.

2. Description of the Prior Art

In the construction industry it is often necessary to operate cranes and excavators in areas having nearby danger zones such as high voltage power lines or other zones which must be kept free from intrusion by the crane and the crane boom. In the past, numerous accidents have occurred when the crane boom, the crane lifting lines or counterweights have come into contact with electrical power lines, and operators have been killed by electrocution. As a result industry and government regulators have recommended that a person be stationed on the ground near an operating crane to observe the clearance between the crane and electrical power lines and to give timely warning of danger for all operations where it is difficult for the operator to monitor the desired clearance by visual means. In practice, it has been found that a ground observer is not a reliable safety element and accidents have occurred when the ground observer was not present or when his attention was diverted.

Some prior art equipment has employed capacitive or inductive voltage pickup devices mounted on an insulating rod extending from the end of the crane and boom, however, such pickup devices are not very sensitive and the devices must be relatively close to electrical power lines for the crane operator to receive a warning signal. If the boom is moving toward the power lines rather rapidly the warning may be received too late and the operator may not be able to stop the boom in time to prevent a disaster. Also, such pickup devices are only useful near power lines and do not warn of other types of danger zones which may exist near the working area.

SUMMARY OF THE INVENTION

The present invention comprises a system for warning a construction equipment operator when a portion of the equipment has reached a boundary of a working space. An energy source such as a laser transmitter develops a field of light or other type of energy to define the boundary of the safe operating area. Energy sensors, such as photosensors, mounted on the outboard portions of the construction equipment provide a warning signal when any of the energy sensors intercepts the energy curtain. This warning signal is used to sound a horn, ring a bell and/or flash a light to alert the equipment operator to the fact that the equipment has reached a boundary of the working space. An additional energy field sensing device is mounted on the ground some distance from the transmitter to sense the continued presence of the energy field and to provide an alarm if the transmitter should fail to develop the energy field. The field sensing device should be placed at least as far from the transmitter as the greatest distance to be expected between the transmitter and the crane sensors. This distance enables the field sensing device to check that the laser transmitter is able to penetrate any dust, fog or other obstructions which could reduce the amount of light received by the crane sensors and insures that the crane sensors will receive sufficient energy to actuate the sensors when they reach the boundary of the working space.

BRIEF DESCRIPTION OF THE DRAWINGS

FIGS. 3A–3C disclose details of a photosensor used to detect the energy curtain.

FIG. 4 is a plan view of a photosensor, illustrating the areas from which light cannot be received by the photosensor, and also illustrating the areas from which light can be received by the photosensors.

FIG. 5 is a plan view of the crane of FIGS. 1 and 2 illustrating areas from which light can and cannot be received by the individual photosensors mounted on the crane.

FIG. 6 is a side elevation of a portion of the crane of FIG. 5 showing the field of view of the photosensors in a plane parallel to the boom of the crane.

FIG. 7 is a perspective view of the construction crane showing two volumes of space that are hidden from the view of the photosensors.

FIG. 8 illustrates another embodiment of the present invention including apparatus which provides an energy field throughout a working space.

DESCRIPTION OF THE PREFERRED EMBODIMENT

Figure 1:
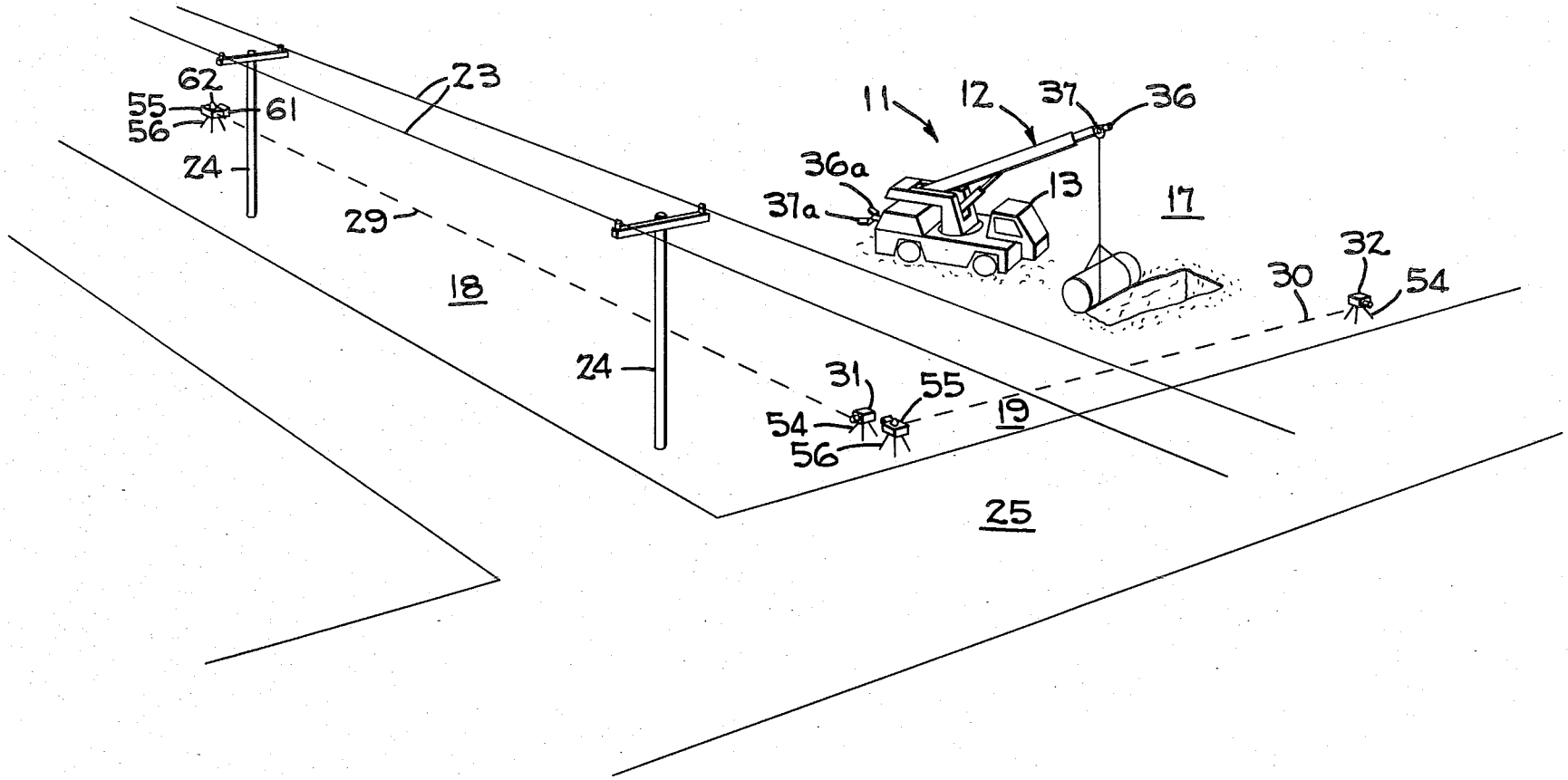
FIG. 1 is a diagrammatic perspective view of a construction area having a boundary plane warning system of the present invention to protect a crane from moving into two separate danger zones.
Figure 2:
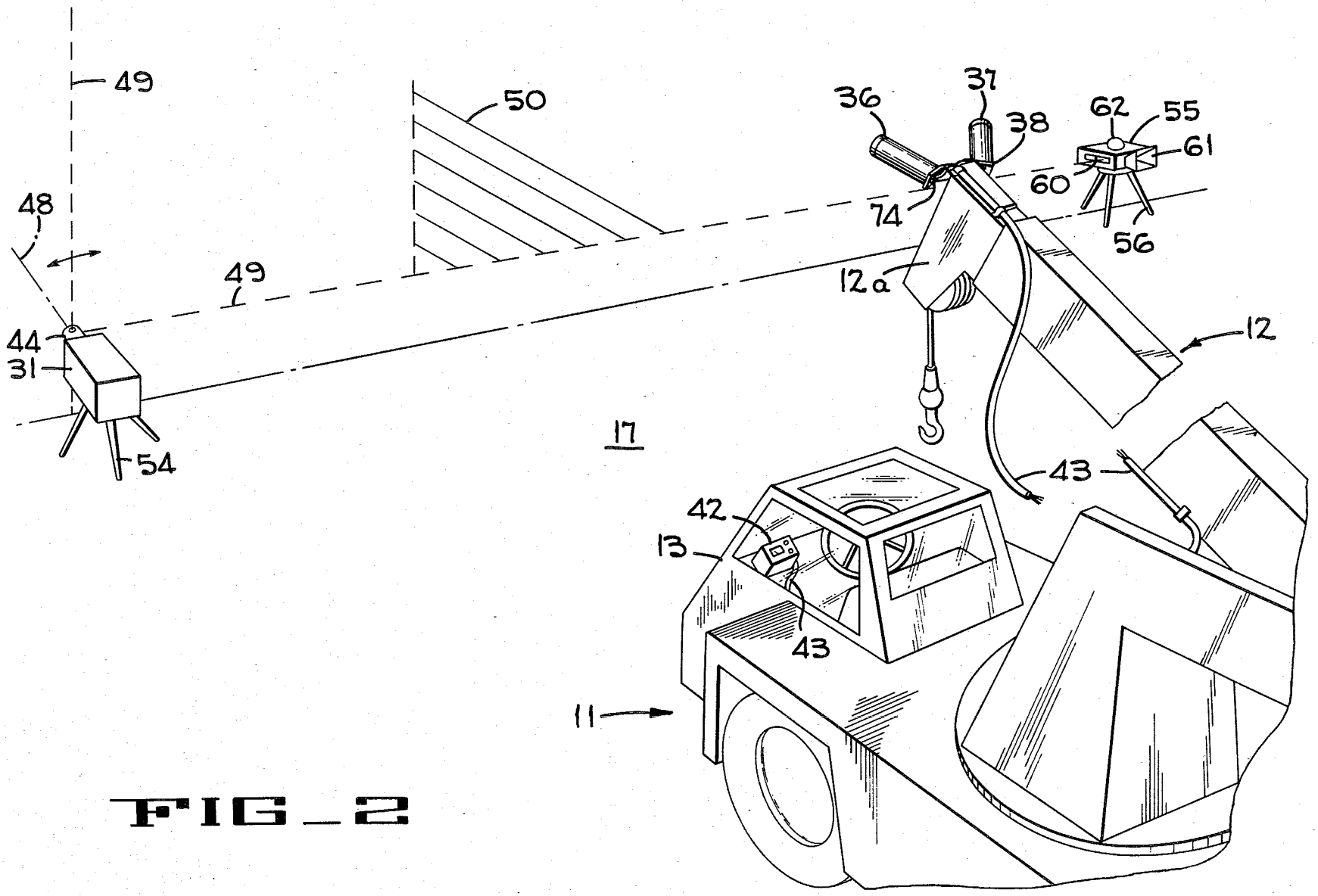
FIG. 2 is an enlarged perspective view of a portion of the warning system of FIG. 1 showing an energy curtain between a working area and a danger zone.

Referring to FIGS. 1 and 2 of the drawings, a boundary plane warning system with an energy curtain according to the present invention is shown for use with a truck crane or other construction equipment 11 having a boom 12 extending generally forward of an operator's cab 13. The truck crane 11 (FIG. 1) is positioned in a working area 17 adjacent to a pair of zones 18, 19 which must be kept free of all portions of the truck crane 11. The zone 18 includes a plurality of electrical power lines 23 mounted on a plurality of utility poles 24, and the zone 19 includes a highway 25. A pair of energy curtains 29, 30 positioned between the working area 17 and the zones 18, 19 are provided by a pair of light transmitters 31, 32 mounted between the working area and the zones 18, 19. It should be understood that other types of energy transmitters which generate electromagnetic waves, infrared, ultraviolet, ultrasonic, microwaves, etc. may be used to generate energy curtains for use in the warning system of the present invention.

A pair of photosensors 36, 37 each mounted on a mounting bracket 38 (FIG. 2) fixed to the outboard portion 12*a* of the boom 12 provide a warning signal whenever one or more of the photosensors 36, 37 is moved into position to intercept one of the energy curtains 29, 30. The warning signal from the photosensor is coupled to an alarm unit 42 (FIG. 2) inside the operator's cab 13 by an electrical cable 43 and provides an alarm to alert the crane operator that the crane boom has reached the boundary of the working space. Another pair of photosensors 36*a*, 37*a* (FIG. 1) are mounted on a second mounting bracket 38*a* connected to the rear portion of the crane 11 to provide a warning when the rear portion of the crane reaches the boundary of the working space.

One light transmitter that can be used to develop the energy curtain is a laser transmitter manufactured by the Spectra-Physics Corporation, Mountain View, Calif. This laser transmitter 31 (FIG. 2) includes a rotating head 44 which rotates at a rate of approximately 20 revolutions per second about a generally horizontal axis 48 to provide a laser ray 49 which sweeps through a plane 50. A single rotating head, which provides several beams positioned like spokes on a wheel, can be used to develop a relatively high scan rate in the plane 50 with a relatively low revolution rate of the head 44. The plane 50 is shown in FIG. 2 as being oriented in a generally vertical direction, but the plane of the laser ray can be tilted by tipping the transmitter 31 to move the rotating axis 48 away from the horizontal position shown. The transmitter 31 is mounted several feet (8 feet or more) above the ground on a tripod 54 to permit foot and vehicle traffic through the lower portion of the energy curtain 29 without obstructing the path between the transmitter 31 and the photosensors 36, 37.

In order to check that the energy curtain is developed and to sound an alarm when the energy curtain fails to develop, a field sensing device 55 is placed on a tripod 56 in position to receive the rays 49 from the laser transmitter 31. When the light rays 49 (FIG. 2) fail to fall on a photosensor 60, an alarm signal is developed by the field sensing device 55 and causes a horn 61 to sound and causes an emergency light 62 to flash to alert the crane operator that the energy curtain is not established.

Figure 9A:
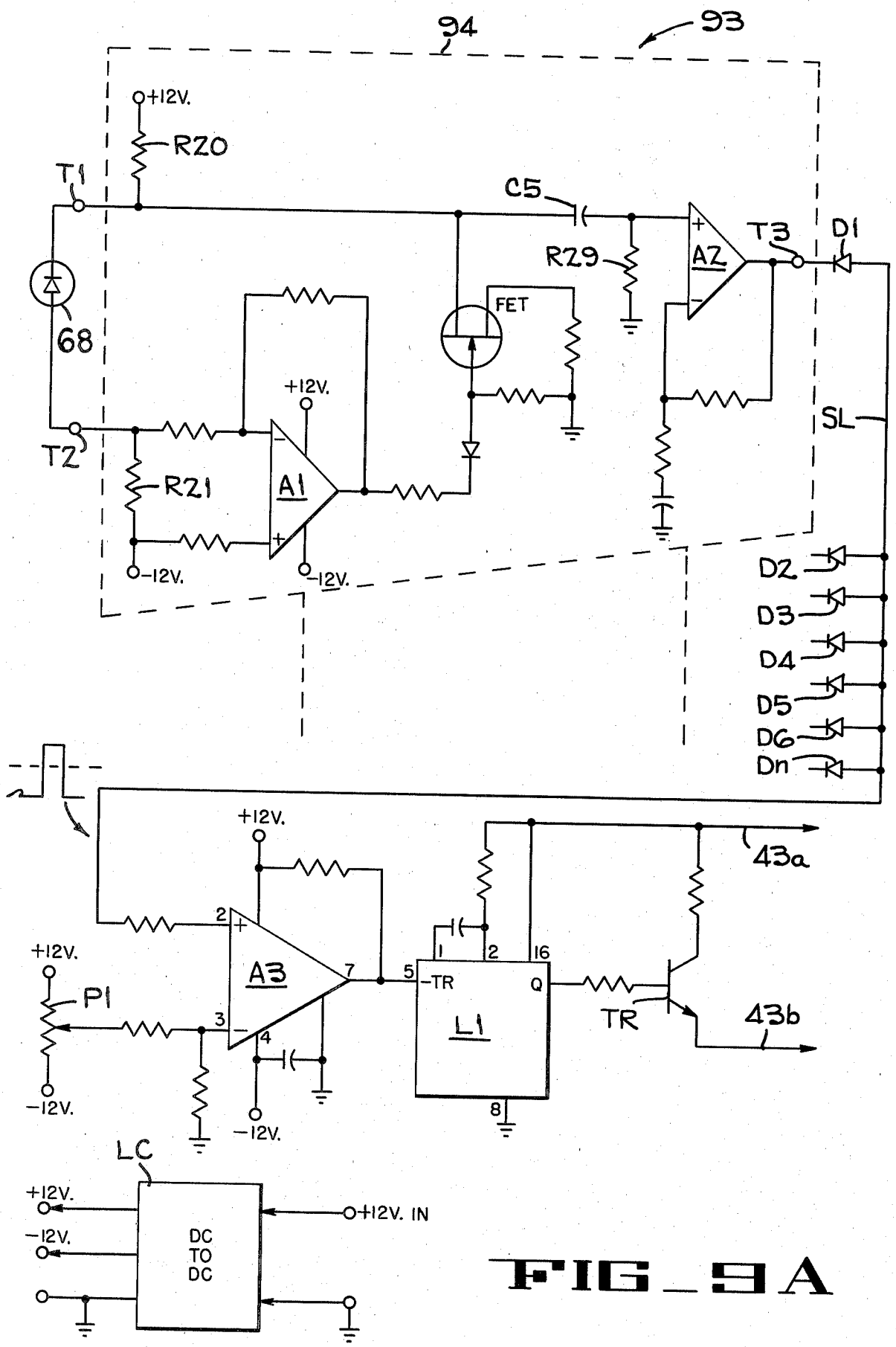
FIG. 9A is a schematic diagram of the laser beam detector circuit which is mounted at the tip of the crane boom.

Details of the crane-mounted photosensors 36, 37 are disclosed in FIGS. 3A–3C and 4. The photosensors each includes an elongated rod 66 having a generally square cross section (FIG. 3C) with a plurality of elongated printed circuit boards 67*a*–67*c* mounted along the length of three of the sides. A plurality of generally rectangular photodiodes 68 (FIG. 3A) are mounted on these printed circuit boards 67*a*–67*c* to form continuous photosensing strips along the length of each of the circuit boards 67*a*–67*c*. A plurality of passband filters 69 are mounted over the photodiodes 68. The photodiodes are each connected to a corresponding one of a plurality of preamplifier and D.C. restorer circuits 94 (FIG. 9A). The field of view of each of the photo diodes, i.e., the angle from which light can be received by each diode (FIG. 3C), is approximately 90 degrees to provide a total field of view of 270 degrees for the three photosensor strips shown. The photodiodes are mounted in a tubular transparent enclosure 72 having an end cap 73*a*, 73*b* at each end of the enclosure. A pair of capscrews 74 (only one being shown in FIG. 2) extending through holes in the mounting bracket 38 into a pair of threaded holes 75 (FIG. 3A) in the cap 73*a* secure the photosensors to the mounting bracket 38 (FIG. 2) on the crane boom 12. Each of the photosensors 36, 37 includes a pair of electrical connectors 78*a*, 38*b* (FIG. 3A) mounted on the cap 73*a* and the connectors are coupled to the photo diodes by a plurality of circuits 94 and diodes D1-Dn (FIG. 9A). The field of view along the axis of each photosensor is approximately 90° (±45° from a normal to the surface of the enclosure 72) as shown in FIG. 3B. The length of the photodiode array is approximately 12 inches to provide sufficient length to insure that the photo diodes 68 intersect the revolving laser beam at least once as the crane boom 12 (FIG. 2) swings into the light curtain 29.

The photosensors 36, 37 are mounted at right angles to each other to compensate for a blind zone 79, 80 (FIG. 4), comprising a 90° cone at each end of the photosensors 36, 37, as shown in the plan view of FIG. 5. The photosensors are each mounted at 45 degrees to a vertical plane 84 (FIG. 5) which vertical plane includes the axis of the boom 12. With this arrangement of mounting the photosensors, the blind zone 79*a* (FIG. 5) of the photosensor 36 is viewed by the photosensor 37 and the blind zone 79*b* of the photosensor 37 is viewed by the photosensor 36. The photosensors 36, 37 are mounted at an angle of approximately 45 degrees below the boom axis 85 (FIG. 6) of the boom. This mounting angle allows the photosensors 36, 37 to receive light from the transmitters 31, 32 as the crane boom operates between an elevation angle between 0° and 90° whenever the receiver moves into the curtain.

A pair of areas 89, 90 which are hidden from view of the photosensors 36, 37 and into which the light transmitter 31 may not be placed to obtain an effective light curtain are illustrated in FIG. 7. The area 89 is shielded from view of the photosensors by the truck crane 11 and the area 90 is shielded from the photosensors by a load 91. The area 90 becomes larger as the load 91 is raised closer to the outboard end 12*a* of the boom. The crane operator must be careful not to move the crane to a location where the transmitter 31 is in either of the areas 89 or 90. The effect of these blind areas can be eliminated by mounting additional photosensors on the rear of the crane as shown in FIGS. 1, 2 and 7 and by mounting photosensors (not shown) on the load. When photosensors are mounted on the load, electronic telemetry may be required to relay a warning signal to the cab of the crane. The blind areas can also be eliminated by using additional laser transmitters placed appropriate distances from the transmitters shown in FIGS. 1 and 2.

An alarm control circuit 92 (FIG. 9B) and a plurality of curtain detector circuits 93 (FIG. 9A) amplify signals generated by the photodiodes 68 within the photosensors 36, 37 and provide warning signals when any one of the photosensors intercepts the warning curtain. The curtain detector circuits 93 each includes a plurality of energy detector and D.C. restorer circuits 94, each having a pair of input terminals T1, T2 connected to a corresponding one of the photo diodes 68 and with an output terminal T3 connected to a signal line SL by one of a plurality of diodes D1–Dn.

A current flows through a load resistor R20 (FIG. 9A) through the photodiode 68 and a current sampling resistor R21. The value of the current through the photodiode is determined by the amount of light falling on the photodiode. When the photodiode 68 operates in bright sunlight, the ambient current caused by the sunlight may be so large that the small signal current caused by a laser beam striking the photocell may be swamped. To prevent the signal current from being swamped it is important to maintain a constant D.C. bias at the load resistor R20. This constant bias is achieved by monitoring the D.C. current through the sampling resistor R21, using an amplifier A1 to differentially amplify this voltage and apply the amplified voltage to the gate of a field effect transistor FET. The amplifier A1 and the FET provide a constant bias current through the resistor R20. The total current through the load resistor R20 is the sum of a drain current through the FET and the current through the photodiode 68. As the current through the photodiode 68 increases, the drain current in the FET decreases so the total quiesent current through the load resistor R20 remains constant.

Variation in current through the photodiode 68 (FIG. 9A) caused by pulses of laser light striking the photo diode, develop pulses of voltage which are coupled through a high pass filter (C5, R29) to a signal amplifier A2. The signal amplifier A2 provides an amplified pulse to a comparator A3 through the diode D1. The comparator A3 is biased by a voltage from a potentiometer P1 to prevent small-amplitude noise from triggering the comparator. A large signal pulse to the comparator input provides a pulse which triggers a one-shot multivibrator L1 causing a transistor TR to provide current from the lead 43*a* to the lead 43*b* of the cable between the operator's cab 13 and the crane boom 12. A 12 volt D.C. to D.C. converter LC mounted on the crane boom 12 provides a −12 volts for the energy detector circuit 94 from a +12 volts on lead 43*a*.

Figure 9B:
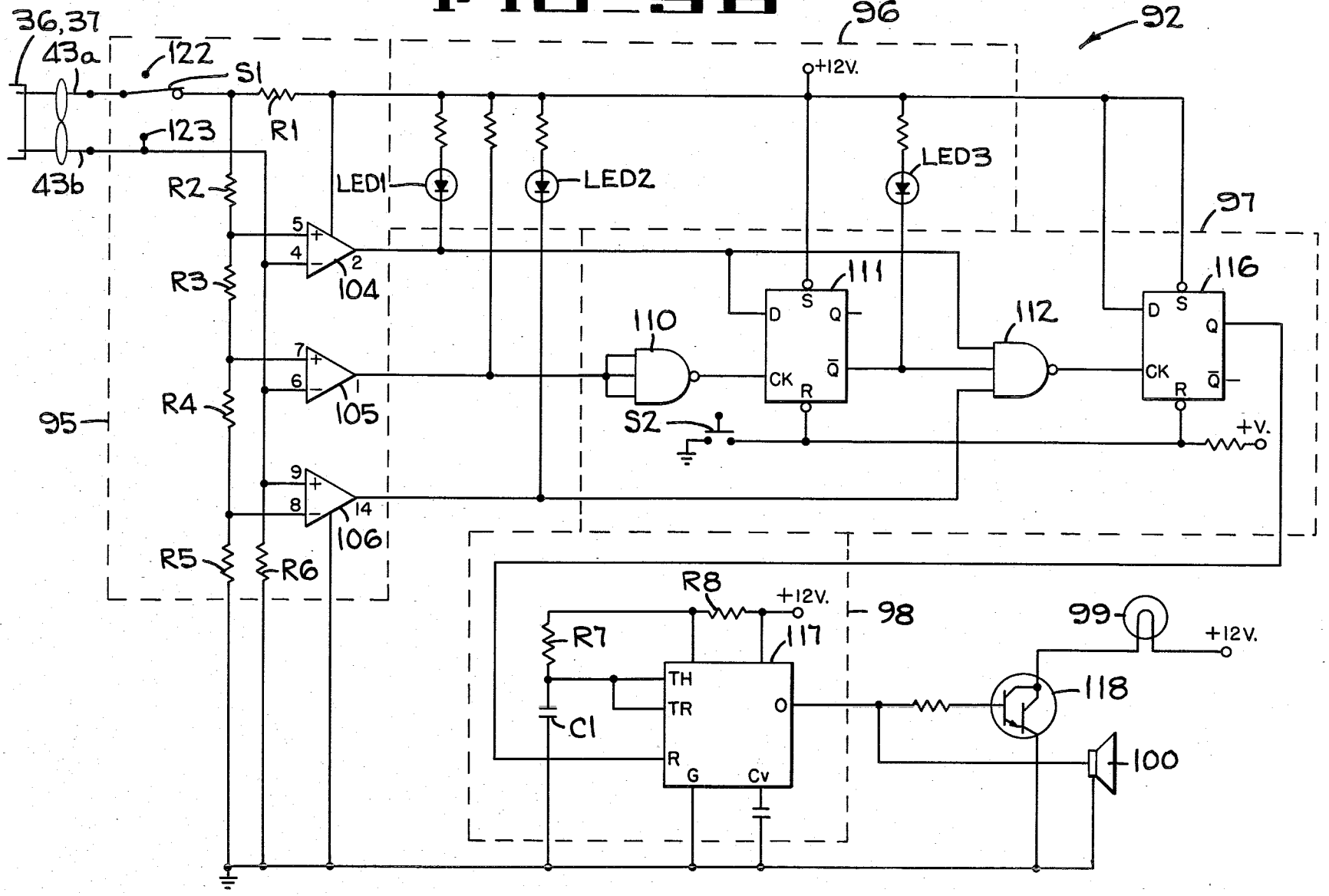
FIG. 9B is a schematic diagram of the circuitry of the laser beam detector and alarm system which is mounted in the crane cab.

The alarm control circuit 92 disclosed in FIG. 9B is mounted in the operator's cab to provide both audio and visual warnings when one of the photosensors 36, 37 intercepts the energy curtain. The circuit includes a comparison circuit 95 which receives signals from the photosensors 36, 37 over the cable leads 43*a*, 43*b* and compares the received signals against a standard voltage to determine if an open or a short circuit exists between the comparison circuit 95 and the photosensors, and to determine if one of the photosensors has intercepted the light curtain. When an open, a short or a light curtain intercept occurs, the comparison circuit 95 provides a warning signal to an indicator circuit 96 to energize a "short" lamp LED1, an "open" lamp LED2 or a "danger zone" lamp LED3. The warning signal also sets a latching circuit 97 which provides an energizing signal to a timing circuit 98 causing the timing circuit 98 to develop signal pulses which provide a pulsating voltage to operate a warning lamp 99 and a buzzer 100.

The comparison circuit 95 includes a voltage divider comprising a plurality of resistors R1–R5 having values chosen so the value of voltage on each of the input terminals 4, 6, 9 of the comparators is lower than the voltage on corresponding terminals 5, 7, 8 when the sensors 36, 37 receive only ambient light and do not intercept the light curtain. The comparators 104–106 each provides a high value of voltage, such as +12 volts on the output terminal when the positive voltage on the positive input terminal is greater than the voltage on the negative input terminal. Conversely, the comparators 104–106 each provide a low value of voltage on the output terminal when the positive voltage on the negative input terminal is greater than the voltage on the positive input terminal. One comparator which can be used in the circuits of FIGS. 9A, 9B is the LM339 manufactured by the National Semiconductor Corporation, Santa Clara, Calif.

With only ambient light falling on the photosensors 36, 37 the voltage on the cable lead 43*b* is low so the voltage on the input terminals 5, 7, 9 of the comparators 104–106 is greater than the voltage on the input terminals 4, 6, 8 causing the value of voltage on each of the output terminals 2, 1, 14 to be high, thereby deenergizing the light emitting diodes LED1, LED2 and enabling the NAND-gate 110. The enabled NAND-gate 110 provides a low voltage to the CK input terminals of a latch 111, causing the latch 111 to provide a high voltage on the $\overline{Q}$ output terminal and deenergizing LED3. The high values of voltage from output terminals of the comparators 104, 106 and from the latch 111 enable a NAND-gate 112 causing the gate 112 to provide a low value of output voltage at the input terminal CK of a latch 116. The latches 111, 116 each provide a low value of output voltage on the $\overline{Q}$ output terminal when the voltage on the input is low and provide a high value of voltage on the $\overline{Q}$ output terminal when the input is low. One such latch which can be used in the circuit of FIG. 9 is the 74C74 latch manufactured by National Semiconductor, Santa Clara, Calif. The high value of voltage from the Q output terminal of latch 116 enables a timer 117 so that the warning lamp 99 and the buzzer 100 are energized.

When one of the photosensors 36, 37 (FIGS. 1–6) intercepts the light curtain the intercepting photosensor 36, 37 provides an increased current on the cable lead 43*b* (FIG. 9A) which increases the voltage across resistor R6 and increases the voltage on the negative input terminal of comparator 105, causing the voltage on the output terminal of comparator 105 to decrease. The low value of output on the output terminal of comparator 105 disables the NAND-gate 110, increases the voltage at the CK input terminal of the latch 111 causing the latch to set and to decrease the voltage on the $\overline{Q}$ output terminal of latch 111. The low value of voltage at the $\overline{Q}$ output terminal of latch 111 energizes LED3 to warn of a danger and provides a low value of voltage to an input lead of NAND-gate 112 causing the NAND-gate 112 to provide a high value of voltage at its output terminal and at the CK input terminal of latch 116. The high value of voltage at the CK input terminal of latch 116 sets the latch causing it to provide a high value of voltage to the input terminal of the timer 117 so that the timer 117 provides a pulsating output voltage which operates the buzzer 100. The voltage from the timer 117 is amplified by a Darlington amplifier 118 and provides pulses of current to energize the lamp 99. The frequency of the pulses from the timer 117 is determined by the values of a pair of resistors R7, R8 and a capacitor C1. One timer which can be used in the circuit of FIG. 9A is the NE556 manufactured by the National Semiconductor Corporation, Santa Clara, Calif.

A test switch S1 is provided for testing the alarm control circuit of FIG. 9A to insure that open circuits and short circuits in the conductors 43*a*, 43*b* will cause the circuit to operate the warning buzzer 100, the warning lamp 99 and the appropriate LED1 or LED2. When the switch S1 is in the open position, at terminal 122, the voltage on the input terminals 5, 7, 8 of the comparators 104–106 is higher than normal and the voltage on terminal 9 of the comparator 106 is extremely low, causing the voltage on the output terminal 14 of the comparator 106 to drop thereby energizing LED2. The low voltage on the output terminal 14 of the comparator 106 also disables the NAND-gate 112, causing the latch 116 to provide a high voltage to timer 117, and to energize the lamp 99 and the buzzer 100.

When the switch S1 is in the short position 123, the voltage on the input terminals 5, 7, 8 of the comparators 104–106 is lower than normal and the voltage on input terminal 4 of the comparator 104 is higher than normal causing the comparator 104 to provide a low value of voltage on the output terminal 2 thereby energizing LED1. The low value of voltage on output terminal 2 also disables the NAND-gate 112, causing the latch 116 to provide a high value of voltage to the timer 117 which operates the buzzer 100 and the warning lamp 99. A reset switch S2 connected to the R terminals of the latches 111, 116 resets these latches after the open or short circuit has been corrected.

Figure 10:
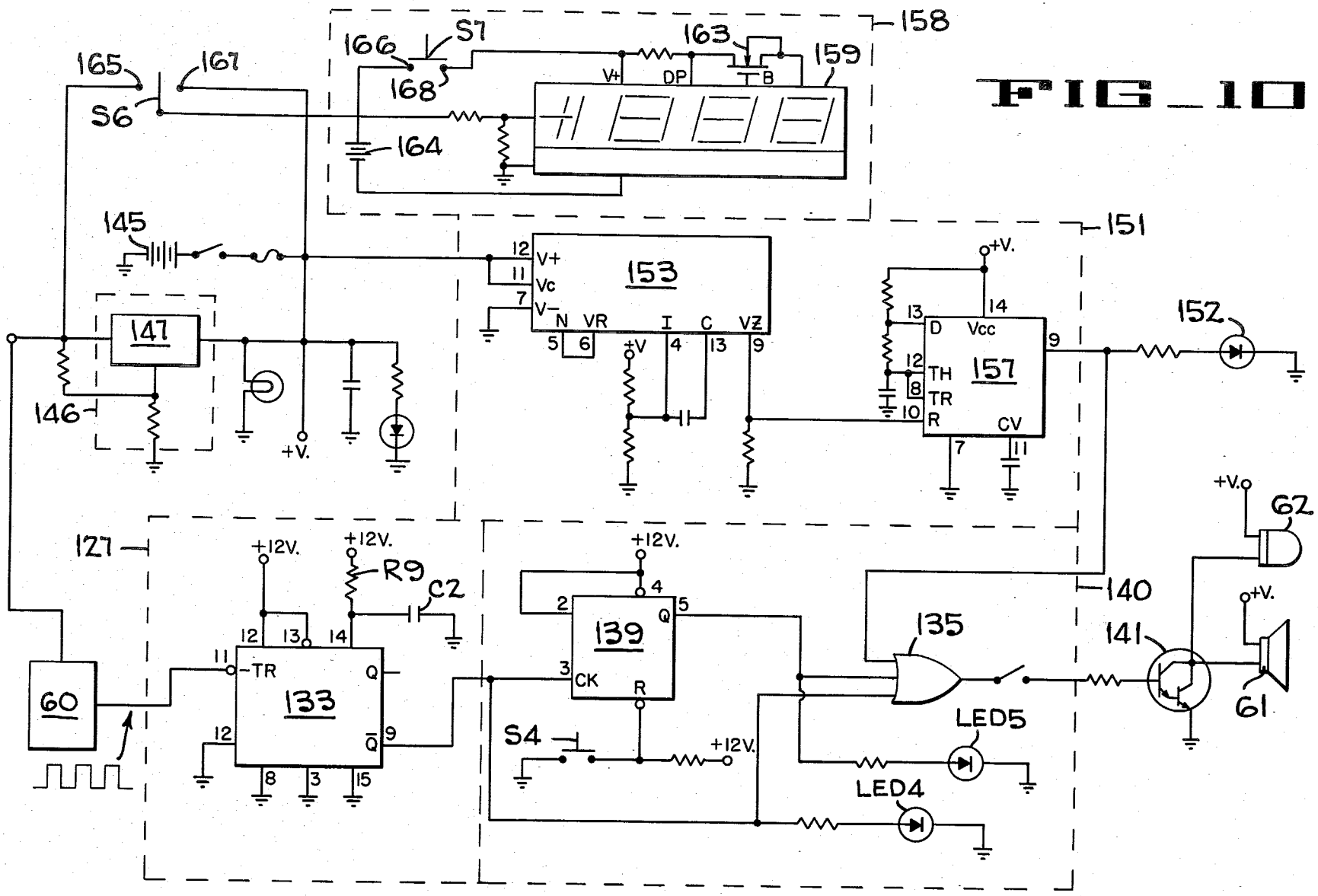
FIG. 10 is a schematic diagram of circuitry which detects any failure of the laser transmitter or failure of the laser energy to reach the energy field sensing device and sounds a warning signal in the event of a failure.

A no-beam detector and alarm circuit for sounding an alarm when the curtain fails to develop is disclosed in FIG. 10. The no-beam detector circuit includes a laser scanning ray detector 127 which receives a positive signal pulse from the photosensor 60 each time the laser beam reaches the photosensor 60 in the field sensing device 55 (FIG. 2). These signal pulses trigger input terminal -TR of retriggerable one-shot multivibrator 133 which provides a low value of output voltage as long as the signal pulses are received from the photosensor 60 and for a period thereafter determined by the values of a pair of timing elements, resistor R9 and capacitor C2. One such multivibrator which can be used in the present circuit is the 4098 built by RCA Corporation. The low value of voltage coupled from the multivibrator 133 to the CLK input terminal of a latch 139 in a latching circuit 140 causes the latch 139 to keep a low value of voltage on the Q output terminal thereby holding a Darlington amplifier 141 in the non-conductive condition and disabling the horn 61 and the emergency light 62. The low voltages on Q terminal of the multivibrator 133 and the $\overline{Q}$ terminal of the latch 139 disable a pair of warning lamps LED4, LED5.

If the photosensor 60 should fail to provide positive output pulses or if the time between the pulses becomes too long, the capacitor C2 discharges through the resistor R9 during the absence of a positive pulse on the input of the timer, thereby causing the voltage on the $\overline{Q}$ output terminal 9 of the multivibrator 133 to increase and causing the voltage on the CK input terminal of the latch 139 to increase. The latch 139 then provides a high value of voltage on the Q output terminal which turns on the Darlington amplifier 141 to activate the horn 61 and the emergency light 62. A switch S4 is provided for resetting the latch 139 by grounding the reset terminal R.

If the laser is misaligned, or for some other reason a laser beam does not strike the photosensor 60 a "no beam" lamp LED4 and a "beam-missing" lamp LED5 will be energized by voltages on the $\overline{Q}$ output terminal of multivibrator 133 and the Q output terminal of the latch 139.

If an obstacle moves intermittently between a laser transmitter 31, 32 and a photosensor 60 the beam-missing lamp LED5 will remain on because eash rising pulse from the multivibrator 133 triggers the latch 139, but the no-beam lamp LED4 will glow dimly. This combination of lamp operations enables a human operator to determine the cause of the horn 61 sounding.

The no-beam detector circuit of FIG. 10 is powered by a standard 12 volt battery 145 that operates all of the circuits except the photosensor 60 which requires a voltage between 8 and 10 volts. One such photosensor 60 which can be used in the present circuit is the Model 975 manufactured by Spectra-Physics, Mountain View, Calif. The regulated voltage for the photocell 60 is provided by a regulator circuit 146 which includes a voltage regulator 147 such as the LM7808 manufactured by the National Semiconductor Corporation, Santa Clara, Calif. A low voltage detector circuit 151 (FIG. 10) is provided to operate a warning lamp 152 whenever the value of the voltage from the battery 145 falls below the 11 volts required for the energy warning system. A voltage of less than 11 volts on the input terminals 11,12 of low voltage detector 153 provides a high value of voltage at the output terminal 9 which actuates a timer 157 to provide output pulses to the warning lamp 152. The high value of voltage from the output terminal of the low voltage detector 157 coupled through an OR gate 135 also activates the horn 61 and the light 62. One such low voltage detector which can be used in the present circuit is the LM723 manufactured by the National Semiconductor Corporation.

A battery checking circuit 158 (FIG. 10) is provided to facilitate checking the voltage from the battery 145. The battery checking circuit 158 includes a digital panel meter 159, a field effect transistor or FET 163, a standard 9 volt battery 164 and a switch S7. One such digital panel meter which can be used in the present invention is the 7106 manufactured by Intersil, Sunnyvale, Calif. When the switch S6 is connected to the terminal 165 and switch S7 is pressed to connect terminals 166 and 168, the voltage from the regulator 147 is checked against the standard battery 164 and the voltage displayed on the panel meter 159. When the switch S6 is connected to the terminal 167 and the switch S7 is pressed to connect terminals 166, 168, the voltage of the main supply battery 145 is checked and displayed on the digital panel meter 159.

Figure 11:
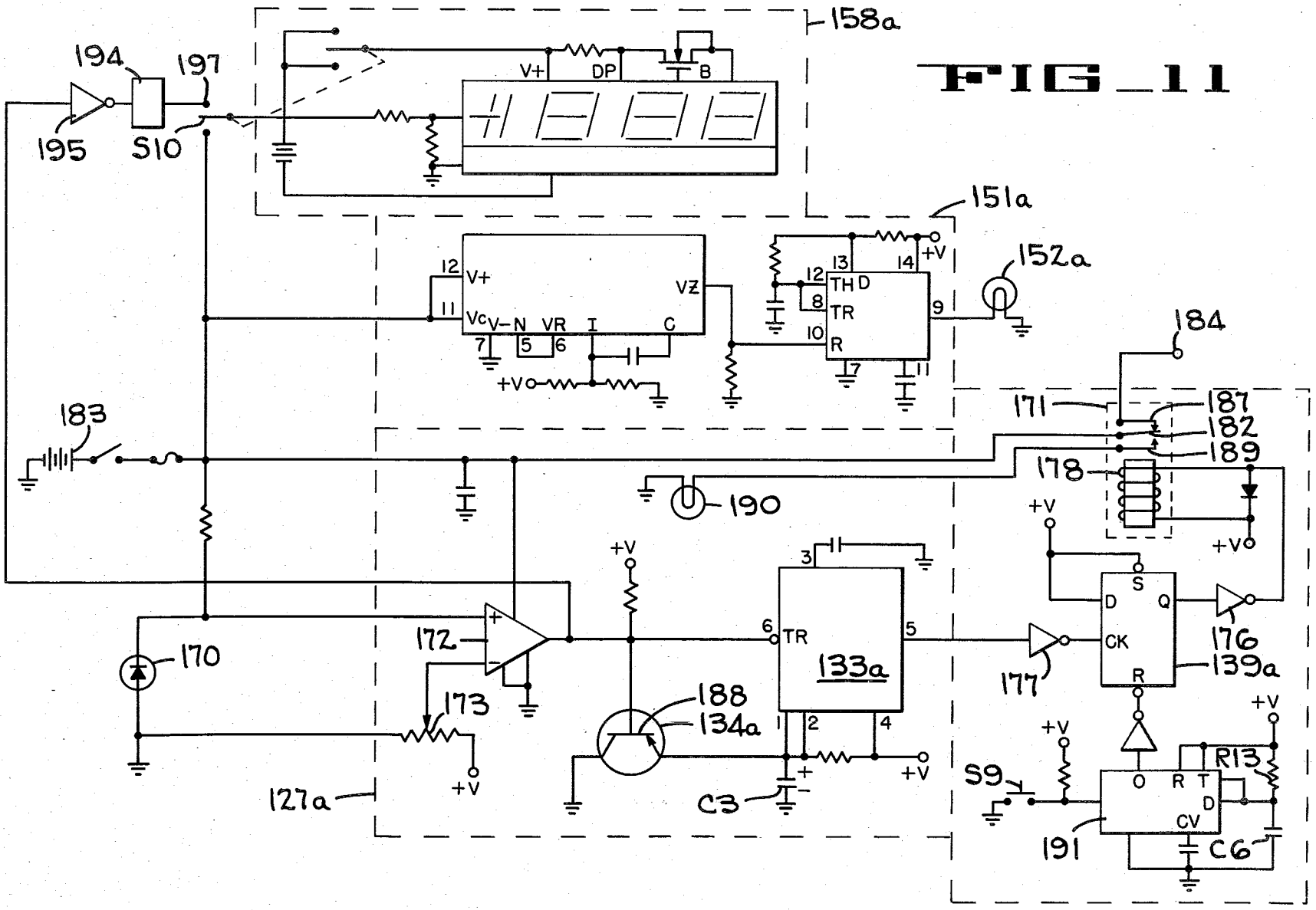
FIG. 11 is a schematic diagram of the laser transmitter shut-off control and laser speed/battery monitor system.

The laser transmitters 31, 32 (FIG. 1) each includes a shutoff beam control circuit (FIG. 11) to remove power from the transmitter when the speed of rotation of the rotating head 44 (FIG. 2) falls below approximately 20 revolutions per second to prevent eye damage to anyone who might be looking at the transmitter. Many of the elements used in the laser beam shutoff control of FIG. 11 are either similar or identical to the elements used in the no-beam detector circuit of FIG. 10 and such elements have been given numbers similar to those in FIG. 10. A photodiode 170 monitors the rotating head 44 and produces a pulse of voltage for each revolution of the head 44. The pulses from the photodiode 170 cause a laser scan rate detector **127*a* to develop a high value of output voltage when the pulse rate is above 20. The high voltage from the scan rate detector 127*a* causes a latch 139*a* to provide a high voltage through an inverter 176 to a relay 171 and causes the relay to connect the battery 183 to the laser transmitter 31** so that the transmitter continues to operate.

When the pulse rate from photodiode 170 falls below approximately 20 per second the scan rate detector **127*a* provides a low value of voltage which causes the latch 139*a* to provide a low voltage to the relay 171 which removes power from the laser transmitter. The voltage pulses from the photodiode 170 (FIG. 11) are coupled to the positive input terminal of a comparator 172 each time the laser beam strikes the photodiode and these pulses are compared against a reference voltage on the negative input terminal of the comparator. The reference voltage can be adjusted to the desired value by a potentiometer 173. Each of the pulses produces a positive pulse at the base of a transistor 134***a* causing the transistor 134*a* to be nonconductive and allowing a capacitor C3 to charge to the polarity shown in FIG. 11. The voltage on capacitor C3 keeps the voltage at the output terminal of the timer 133*a* at a high value. The high value of voltage is coupled through an inverter 177 which provides a low value of voltage at the CK input terminal of the latch 139*a*, thereby causing the latch to provide a low value of voltage at the −X output terminal. The low value of voltage is inverted by the inverter 176 and coupled to the coil 178 of the relay 171. The relay is deenergized and the relay switch 182 is retained against the upper contact 187 so that a voltage is coupled from the 12 volt battery 183 through the relay to the laser transmitter which is connected to a voltage supply terminal 184.

When the frequency of the light pulses falling on the photodiode 170 fall below approximately 20 pulses per second the voltage at the base 188 of the transistor 134*a* decreases for a relatively long period of time allowing the capacitor C3 to discharge and causing the output voltage from the timer 133*a* to decrease. The decreased voltage from the timer causes the latch 139*a* to provide a high value of output voltage and causes the relay switch 182 to move down to the lower contact 189 thereby energizing a warning light 190 and removing power from the laser transmitter.

A delay timer 191, a capacitor C6 and a resistor R13 prevent the latch 139*a* from removing power from the laser transmitter during "start-up" time. When a switch S9 is closed the timer 191 applies a reset voltage to the latch 139*a* to cause the latch to provide a low value of voltage on the −X output terminal so the relay 171 is deenergized. The values of capacitor C6 and resistor R13 determine the duration of time that the timer 191 holds the latch in a reset condition. One timer which can be used is the NE556 described above.

The low voltage detector circuit 151*a* (FIG. 11) is coupled to the battery 183 and provides a warning voltage to a warning lamp 152*a* when the battery voltage falls below a predetermined value in the manner described in connection with the circuit of FIG. 10. The battery checking circuit 158*a* operates in the same manner as the battery checking circuit 158 of FIG. 10 to check the voltage of the power supply battery 183. In addition, the circuit 158*a* also receives a voltage from a frequency-to-voltage converter 194 and provides a voltage reading which is directly proportional to the speed of revolution of the rotating head 44 (FIG. 2) of the laser transmitter 31. The voltage pulses are coupled to the frequency-to-voltage converter 194 from the output terminal of the comparator 172 and through an inverter 195 to the input terminal of the converter 194. A switch S10 can be switched from the battery output to the converter 194 output on terminal 197 when it is desired to check the frequency of rotation of the rotating head of the laser transmitter. One frequency-to-voltage converter which can be used in the circuit of FIG. 11 is the A-8402 manufactured by Intech Corporation, Santa Clara, Calif.

Another embodiment of the boundary plane warning system, disclosed in FIG. 8 includes an energy transmitter 196 which provides a field of energy throughout the space 200. A plurality of sensors 201 receive energy from the transmitter 196 and disable the usual warning horn and lights (not shown) as long as the sensors remain in the energy field. When one or more of the sensors 201 move outside the energy field the horn and warning lights are energized. The transmitter 196 can be a type which provides electromagnetic energy or ultrasonic energy and the sensors 201 are a type which respond to the energy delivered by the transmitter.

Figures 12, 13, 14:
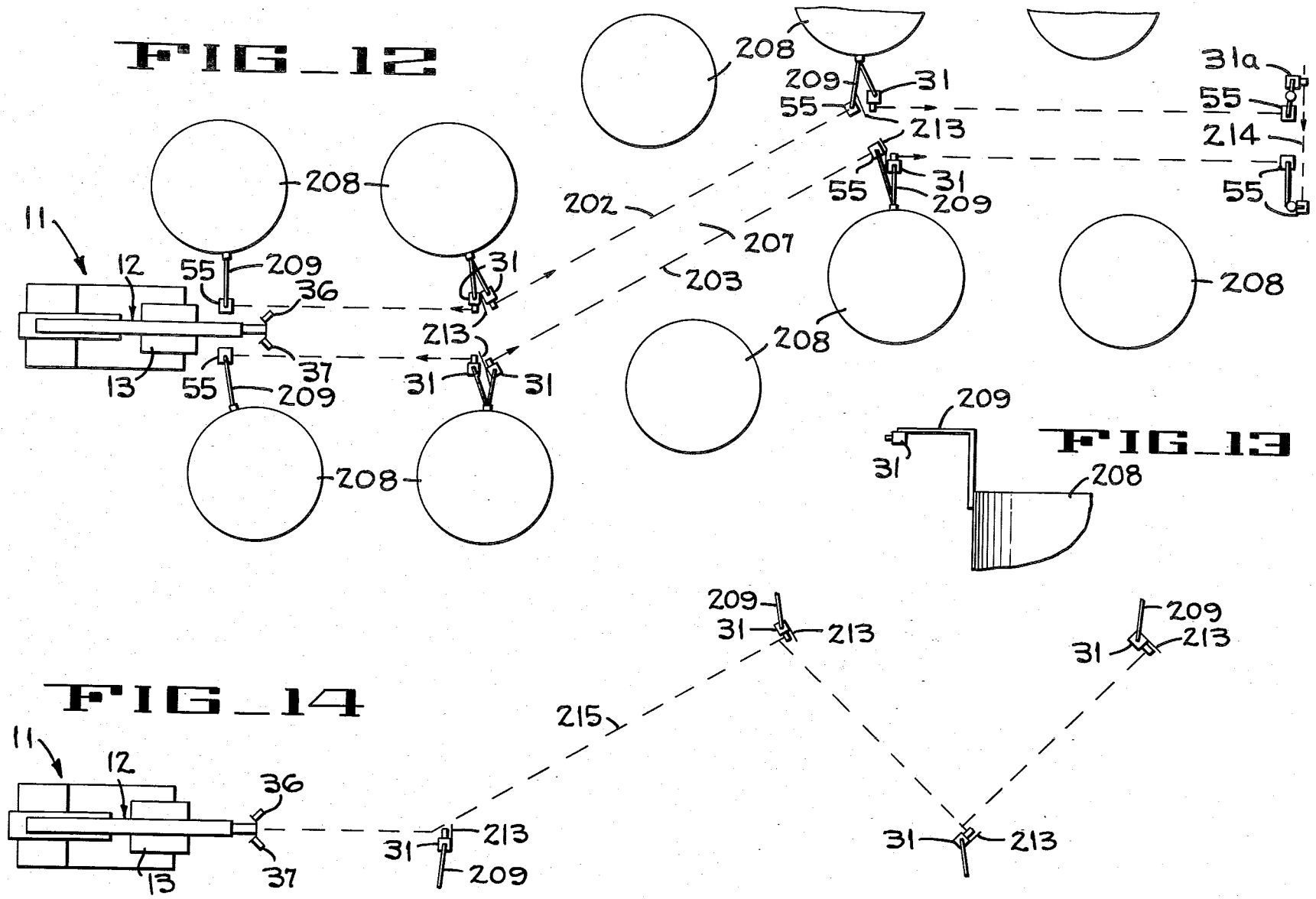
FIG. 12 is a plan view of a warning system used to guide a crane along a path between a plurality of obstacles.
FIG. 13 is an enlarged side elevation of a portion of the system of FIG. 12 ilustrating means for mounting the laser transmitters.
FIG. 14 is a plan view of another embodiment of a system used to guide a crane along a predetermined path.

Another embodiment of the warning system, disclosed in FIGS. 12, 13 includes a plurality of light transmitters 31 (FIG. 12) which provide a pair of curtains 202, 203 to mark the sides of a path 207, and guide the crane 11 between a plurality of storage tanks or other obstacles 208. The light transmitters 31 each provide a short section of the light curtain which is monitored by a corresponding one of a plurality of field sensing devices 55 of the type disclosed in FIGS. 1 and 2. The transmitters 31 and the sensing devices 55 are connected to the storage tanks 208 by a plurality of brackets 209 (FIGS. 12, 13) to position the device 55 and the transmitters 31 above the crane 11 as to moves down the path 207. A light shield 213 (FIG. 12) adjacent the rotating head 44 of the transmitter 31 prevents the light curtains 202, 203 from extending into the path 207. A transmitter 31*a* provides a light curtain 214 at the end of the path 207. As the crane 11 moves along the path 207 the intrusion of the photosensors 36, 37 into either of the curtains provides a warning which tells the crane operator that he has reached the edge of the path. A pair of the warning circuits of the type disclosed in FIG. 9B can be mounted in the cab 13 with one of the warning circuits connected to the photosensor 36 and the other warning circuit connected to the photosensor 37. The corresponding warning lamp 99 of the warning circuit informs the crane operator which of the curtains 202, 203 has been intercepted by a photosensor so the operator can correct the direction of travel.

In another embodiment of the warning system of FIG. 12, the revolution rate of the rotating laser heads 44 along the right side of the path is different than the revolution rate of the laser heads 44 along the left side of the path and this difference can be discerned by the curtain detector circuits to determine which of the energy curtains has been intercepted by the photosensors 36, 37.

Another embodiment of the warning system as disclosed in FIG. 14 uses a single light curtain 215 to guide the crane 11 along a safe path. The curtain must be thick enough so that both the photosensors 36, 37 receive light from one of the light transmitters 31 when the boom 12 is on the safe path. When the boom 12 moves toward the edge of the thick curtain only one of the photosensors receives light from the curtain. A pair of warning circuits of the type disclosed in FIG. 9 are mounted in the cab 13 (FIG. 14) with one circuit connected to photosensor 36 and the other circuit connected to photosensor 37. When the boom 12 is in the center of the curtain 215 the lamps 99 (FIG. 9B) of both circuits are energized. When the boom 12 moves away from the center of the curtain 215 one of the lamps 99 becomes deenergized to inform the crane operator that a correction in boom position is necessary.

The boundary plane warning system of the present invention provides an improved system for warning a construction equipment operator that the equipment has reached the boundary of a working space by energizing appropriate lights and alarms. A laser transmitter defines the boundary and one or more photosensors, mounted on the equipment develop alarm signals when these sensors reach the boundary.

Although the best mode contemplated for carrying out the present invention has been herein shown and described, it will be apparent that the modification and variation may be made without departing from what is regarded to be the subject matter of the invention.

What is claimed is:

1. A warning system for alerting an equipment operator that a portion of the equipment has reached the boundary of a working space, said system comprising:

an energy source for developing a curtain of energy to define the boundary of said working space;

an energy sensitive sensor mounted on an outboard portion of said equipment to provide a warning signal when said sensor reaches said energy curtain; and means for using said warning signal to alert said equipment operator that said equipment has reached the boundary of said working space.

2. A warning system as defined in claim 1 including a pair of said energy sensitive sensors, and means for mounting said energy sensitive sensors to insure that at least one of said sensors receives energy from said energy source when a portion of said equipment is in said energy curtain.

3. A warning system as defined in claim 1 including a plurality of said energy sensors, and means for mounting said energy sensors to receive energy propagated from any direction toward said equipment.

4. A warning system for alerting an equipment operator that a portion of the equipment has reached the boundary of a working space, said system comprising:

an energy source for developing a field of energy which fills said working space;

an energy sensitive sensor mounted on an outboard portion of said equipment to provide a warning signal when said sensor leaves said energy field; and means for using said warning signal to alert said equipment operator that said equipment has reached the boundary of said working space.

5. A warning system for alerting an equipment operator that a portion of the equipment has reached a boundary of a working space, said system comprising:

an energy source for developing a field of energy to define the boundary of said working space;

an energy sensitive sensor mounted on an outboard portion of said equipment to provide a warning signal when said sensor reaches said energy boundary;

an energy sensing device mounted to intercept a portion of said energy field and to provide an alarm signal when said energy field fails to develop; and means for using said warning signal to alert said equipment operator that said equipment has reached the boundary of said working space.

6. A warning system as defined in claim 5 including a pair of said energy sensitive sensors, and means for mounting said energy sensitive sensors to insure that at least one of said sensors receives energy from said energy source when a portion of said equipment is in said energy field.

7. A warning system as defined in claim 5 wherein said energy field forms a curtain at the boundary of said working space.

8. A warning system as defined in claim 5 wherein said energy field fills said working space and means for generating said warning signal when said sensor leaves said energy field.

9. A warning system for alerting an operator that the boom of a crane is approaching the boundary of a working space, said system comprising:

a laser transmitter having a rotating laser beam to continuously sweep through a predetermined plane adjacent said working space and to effect a curtain of light to define the boundary of said working space;

a photosensor which develops a warning signal when said sensor intercepts said laser beam;

means for mounting said photosensor at the outboard portion of said crane boom; and an alarm device coupled to said photosensor for providing an alarm signal in response to said warning signal from said photosensor.

10. A warning system as defined in claim 9 wherein said photosensor has sufficient size to insure that said photosensor intercepts said rotating laser beam and develops said warning signal when said photosensor moves through said curtain at the normal speeds of movement of said crane boom.

11. A warning system as defined in claim 9 including means for mounting said photosensor on an extension beyond an outboard end of said crane boom to reduce the chance of the crane boom and other portions of the crane from moving into a position between said photosensor and said laser transmitter.

12. A warning system as defined in claim 9 including a curtain sensing device mounted to intercept a portion of said light curtain, said curtain sensing device providing an alarm signal when said light curtain fails to develop.

13. A warning system as defined in claim 12 including means for mounting said laser transmitter and said curtain sensing device above the ground to prevent people and vehicles on the ground from interrupting the beam between said transmitter and said curtain sensing device.

14. A warning system as defined in claim 12 wherein said curtain sensing device provides an alarm signal when fog, dust, rain, snow or other obstructions reduce the amount of light received by said curtain sensing device below a predetermined value.

15. A warning system as defined in claim 12 wherein said curtain sensing device is mounted at a position further from said laser transmitter than the greatest working distance between said laser transmitter and said energy sensor on said equipment to ensure that said laser beam can penetrate any fog, dust, rain or other obstructions between said laser transmitter and said energy sensor.

16. A warning system for aiding an equipment operator in guiding equipment along a working path and for alerting said operator when said equipment deviates from said working path, said system comprising:

an energy source for developing a curtain of energy defining said working path;

an energy sensor mounted on said equipment to provide a warning signal when said sensor deviates from said working path; and means for using said warning signal to alert said operator that said equipment has deviated from said working path.

17. A warning system as defined in claim 12 including means for signaling that said equipment has reached the end of said working path.

18. A warning system as defined in claim 16 including means for directing said energy field along the middle of said working path.

19. A warning system for aiding an equipment operator in guiding equipment along a working path and for alerting said operator when said equipment deviates from said working path, said system comprising:

a pair of energy sources for developing a pair of energy curtains defining the edges of said working path;

at least one energy sensor mounted on said equipment to provide a warning signal when said sensor moves to the edge of said working path; and means for using said warning signal to alert said operator that said sensor has reached the edge of said working path.

* * * * *